United States Patent [19]

Otto

[11] 4,306,367

[45] Dec. 22, 1981

[54] TAMPER RESISTANT MEANS FOR ON-PACKAGE PEELABLE PREMIUM

[75] Inventor: Michael J. Otto, Kalamazoo, Mich.

[73] Assignee: General Foods Corporation, White Plains, N.Y.

[21] Appl. No.: 139,045

[22] Filed: Apr. 10, 1980

[51] Int. Cl.[3] ..... G09F 3/00

[52] U.S. Cl. ..... 40/312; 40/2 R; 40/615

[58] Field of Search ..... 40/2 R, 310, 306, 312, 40/22, 615; 283/6, 18, 21

[56] References Cited

U.S. PATENT DOCUMENTS

| | | | |
|---|---|---|---|
| 1,004,055 | 9/1911 | Martin et al. | 283/21 |
| 2,167,386 | 8/1939 | Claff | 40/312 |
| 2,593,966 | 4/1952 | Born | 40/312 |
| 3,110,121 | 11/1963 | Corrinet | 40/312 |
| 3,524,271 | 8/1970 | Buske | 40/2 R |
| 3,638,340 | 2/1972 | Gottschalk | 40/2 R X |
| 3,958,744 | 5/1976 | Herglotz | 229/6 R |

FOREIGN PATENT DOCUMENTS

| | | | |
|---|---|---|---|
| 6398 | of 1899 | United Kingdom | 40/2 R |
| 8971 | of 1912 | United Kingdom | 40/2 R |

*Primary Examiner*—Gene Mancene
*Assistant Examiner*—Wenceslao J. Contreras
*Attorney, Agent, or Firm*—C. Garman Hubbard; Thomas V. Sullivan; Bruno P. Struzzi

[57] ABSTRACT

In cartons made from laminated packaging material wherein a peelably removable section of the outer ply is defined by a weakened tear line and said section is unadhered to the substrate, resistance to unauthorized tampering or removal of such section from said container is achieved by utilizing a water soluble adhesive as a laminant and including a border area of said section at the starting point of the tear outline within the area of adherence by said laminant to thus require application of moisture to said border area to dissolve said adhesive at said area before the tearing away of such section can be accomplished.

10 Claims, 4 Drawing Figures

TAMPER RESISTANT MEANS FOR ON-PACKAGE PEELABLE PREMIUM

BACKGROUND OF THE INVENTION (1) Field of the Invention

This invention relates generally to laminated web material adaptable for use in packaging and convertible into various types of containers such as cartons or the like suitable for the packaging of consumer oriented products. More particularly, the invention relates to containers made from laminated packaging material of this character which is so constructed as to enable a selected area of one ply of the material to be readily peeled from or delaminated with respect to the other ply of the material by the consumer or ultimate purchaser of the products so packaged without significantly affecting the integrity of the container structurally.

It has long been a wide spread practice in the marketing of packaged consumer oriented products to offer with the package, as an inducement to purchase, a promotional item or premium which may take the form of a coupon, trading stamp, picture or the like. These items have traditionally been attached in some way to the exterior of the package or inserted within the package at the time the package was filled. Also, in the case of printed material such as coupons, they have been printed on the surface of the carton or container in which the product is packaged with the intent that they be cut out from the structure of the carton prior to redemption thereof. All of the above mentioned methods of including coupons or the like with packaged goods have involved certain disadvantages whether it be pilferage of the coupon in cases where they are externally attached to the package, inadvertent failure to stuff the coupon in cases where they are inserted within the package, or destruction of the carton itself as an incident to redemption in those instances where the coupons are printed directly on the surface of the packaging material from which the cartons or containers are constructed.

More recently there has been developed and introduced into the marketplace a carton construction employing laminated packaging material, such as for example paper laminated to paperboard, wherein the premium item such as a coupon or the like is printed on a pre-determined section of the outer paper ply, preferably within one panel of the carton, which section furthermore is unadhered to the paper board substrate and is defined by lines of weakening such as perforated tear lines so as to be readily removable from the carton by a peeling action without significantly impairing the structural integrity of the carton. One of the advantages in this type of construction is to enable instant redemption of the coupon at the time of purchase. It has, however, been found since the wide spread use of a carton structure of this type which renders a coupon readily removable, without requiring any accessory equipment or sharp implements, that there has been a considerable and growing amount of unauthorized misuse and illegal acquisition of coupons of this type by persons other than the purchasers of the associated product, due to their ease of removal from the carton structure, and occurring mainly in retail establishments whereat said products are displayed for sale to the consumer. This practice obviously leads to situations where unauthorized persons acquire the value of the coupon or other promotional item without due consideration paid therefor, and leaves on the shelf of the retail establishment a carton or the like partially defaced so as to be unsaleable and thus a complete loss to the retailer or the product manufacturer. The present invention is directed to avoidance of this problem occurring at the point of purchase and is concerned with rendering such peelable coupons less readily removable by requiring the application thereto of an agent not readily available at the point of purchase to enable a subsequent peeling of a coupon to be accomplished.

(2) The Prior Art

In the prior patent to Martin et al. U.S. Pat. No. 1,004,055 issued Sept. 26, 1911, there is disclosed a container in the form of a rigid can having a label affixed thereto and including as an integral portion thereof a trading stamp. Said stamp is bounded by a perforated tear line including a tab to enable the stamp to be removed from the label without otherwise impairing the label or the container to which it is affixed. A somewhat similar construction is disclosed in a patent to Gottschalk, U.S. Pat. No. 3,835,564 issued Sept. 17, 1974. In this patent a portion of the label affixed to a rigid can includes a decal bordered by a perforated tear line which enables the decal to be removed from the label without otherwise impairing the label or the container to which it is affixed. In both of said references the peelable portions of the label are freely removable without requiring any preconditioning whatsoever, thereby rendering the respective structures susceptible to tampering and illegal removal of the premium portion by unauthorized persons.

U.S. patent to Corrinet, No. 3,110,121 issued Nov. 12, 1963, discloses a coupon embodied in the outer wrap or label for a tubular container, which coupon is bordered on three sides by a perforated tear line with its fourth side constituting a portion of the edge of the outer wrap so as to enable easy grasping thereof to start the peeling action. The structure of this reference is designed to enable easy grasping and removal of the peelable coupon portion, thus also rendering it susceptible to tampering and illegal removal by unintended or unauthorized persons.

U.S. Pat. to Herglotz No. 3,958,744, issued May 25, 1976, also discloses an on-package peelable coupon. However, the packaging material is not a laminate of paper and board, and peelability relies on the separability of the fibrous layers of paperboard, per se.

There is also pending in the United States Patent Office two applications of common ownership herewith: Price et al. Ser. No. 836,873 filed Sept. 26, 1977 and Ray et al. Ser. No. 002,701 filed Jan. 10, 1979. Both of said applications disclose carton structures made from laminated packaging material, the former application disclosing a readily peelable coupon or the like embodied in the outer ply of the laminated material and entirely within one panel thereof, so as to be completely enclosed by a tear outline. In the latter above application, the construction is somewhat similar to the former as to peelability, but the removable portion of the outer ply contains a decorative image printed in sublimation ink so as to enable transfer of said image to another article as an "iron-on" under suitable application of heat and pressure. Packaging in accordance with both of these pending applications has been in the marketplace now for a sufficient length of time to reveal the need for some means to resist tampering with or removal of such coupons, premiums or the like by persons other than the actual purchasers of the respective cartons, and it is with the solution of this problem that the present application is concerned.

SUMMARY OF THE INVENTION

In accordance with the invention, the removable section of the outer ply of the laminated carton structure which constitutes a coupon, premium or the like is as is also shown in the co-pending application Ser. No. 002,701, bounded by a line of weakening or perforated tear line to facilitate the peeling action and direct the tearing along its intended course. The perforated tear line is designed so as to enable the start of the peeling action to begin at one place only. Preferably this location is identified by a protuberance in the contour of the tear line serving as a tab of sufficient size and defined in part by a continuous cut such as to enable easy grasping thereof by the fingers of the user. In prior structures of this general type, this pull tab or starting point for beginning the peeling operation is left nonadhered to the substrate material which thereby enables anyone having access to the carton to freely tamper with and actually remove the coupon or the like from the carton without there being any impediment to such illegal removal by unauthorized persons. This freely accessible pull tab resulted from the application of an adhesive repellent or release agent coating to the underside of the pull tab area as well as to the main coupon area itself, so as to prevent bonding thereof to the substrate during the lamination of the outer ply with the substrate.

In accordance with the invention, the pull tab area of the coupon is adhered to the substrate so as to constitute an obstacle or impediment to unauthorized or illegal tampering therewith, said adhesive bond, however, being nullified by application thereto of an agent capable of rendering the adhesive laminant nonadhesive. This result is achieved by utilizing as a laminant for the laminated packaging material a water soluble adhesive and by applying the adhesive repellent coating to the backside of the coupon in a pattern which does not include or avoids the backside of the pull tab area of the coupon. Thus, in the completed package the pull tab, which otherwise constitutes the only available portion of the coupon for initiating the peeling action, is firmly adhered to the substrate thereby deterring any unauthorized peeling or tampering with the coupon. However, the eventual consumer or purchaser of the carton needs only to moisten the pull tab area such as with a damp sponge or rag and which moistening will penetrate the fibers of the paper and dissolve the water soluble adhesive bonding the pull tab to the substrate. If desired a water repellent coating may be applied to the outer surface of the carton except in the area of the pull tab. This will have the effect of preventing any moisture from penetrating into and weakening other areas of the carton or coupon incident to application of moisture to the pull tab. After the tab has thus been moistened and the moisture has had an opportunity to penetrate and dissolve the adhesive, the tab can readily be loosened with a fingernail and easily be grasped to effect coupon removal.

It is, therefore, an object of the invention, in a laminated carton structure having means for peelably removing a predetermined section of the out ply thereof, to render the peelable removal of said section tamper resistant so as to discourage illegal peeling of said section from said carton by unauthorized persons.

It is a further object of the invention, in a carton structure of the character described having a section of the outer ply thereof peelable therefrom, to require application of a conditioning agent thereto before such section can be peelably removed.

And the still further object of the invention, in a carton construction of the character described having a section of the outer ply thereof peelably removable therefrom, to require the application of moisture thereto or to a portion thereof before such section can be peelably removed from said carton structure.

Further objects of the invention together with features contributing thereto and advantages accruing therefrom will be apparent from the following description when read in conjunction with the drawing.

DETAILED DESCRIPTION

Figure 1:
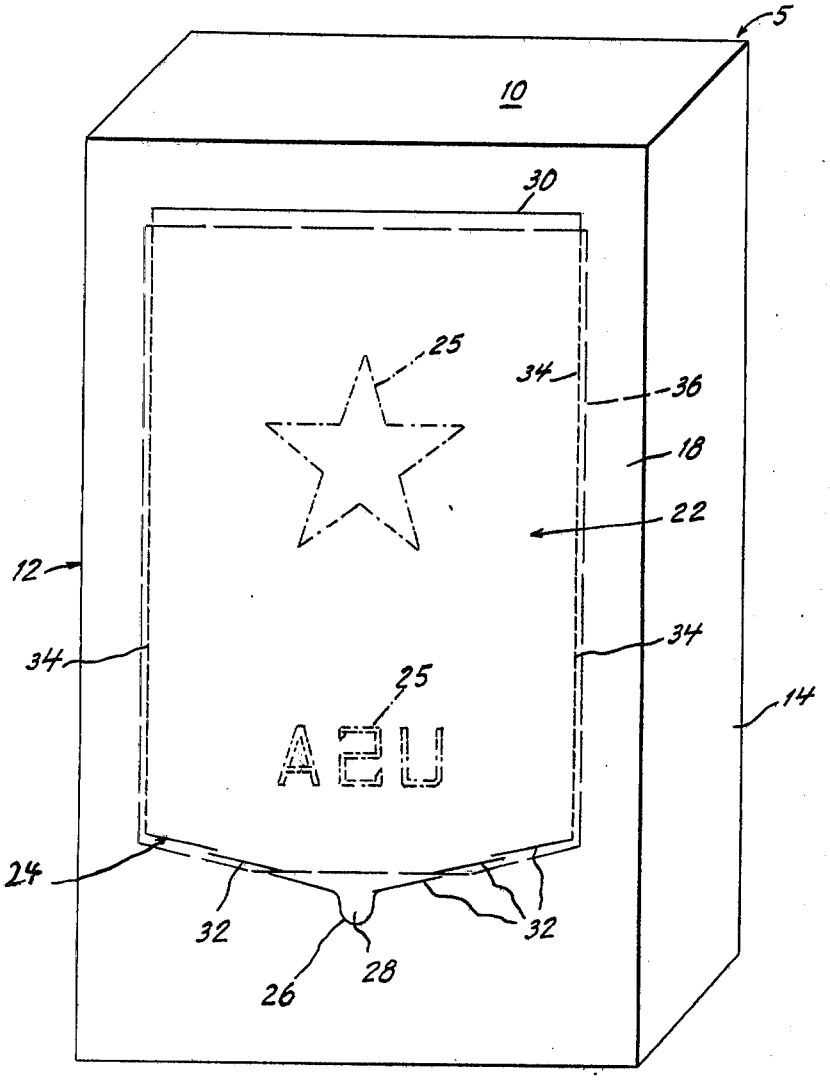
FIG. 1 is a perspective view of a laminated carton or container structure incorporating a peelably removable premium or the like on one panel thereof.

Referring now to the drawing the invention is shown in an embodiment incorporated in an otherwise conventional folding carton 5 of the type commonly employed for containing consumer oriented products such as manufactured food items, for example, cereals, crackers, pet foods or the like. Said carton as shown in the perspective view of FIG. 1 includes a top closure flap 10, a sidewall panel 12, which for purposes of this description may be considered the rear panel of the carton, and an end wall panel 14.

Figure 3:
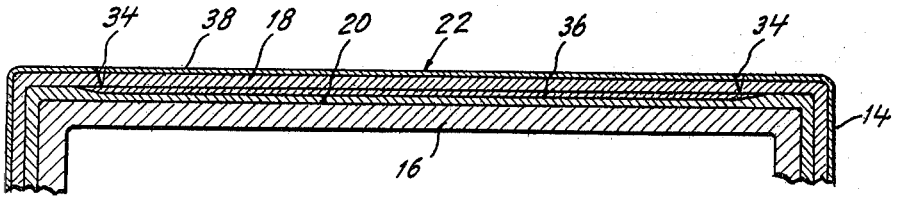
FIG. 3 is a sectional view of said panel taken along the line 3—3 of FIG. 2.
Figure 2:
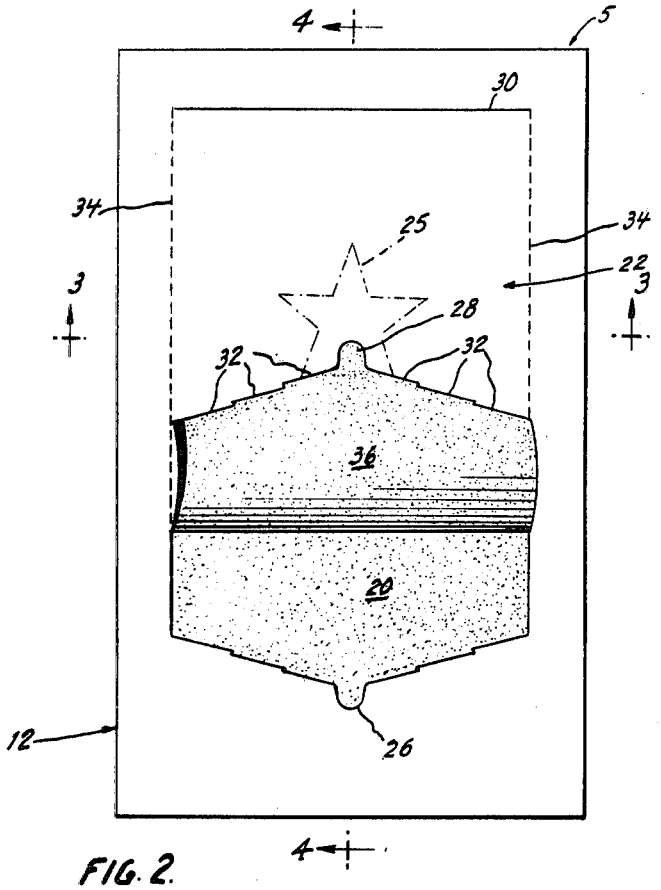
FIG. 2 is an elevational view of the carton of FIG. 1 showing the peelable section incorporated in said panel partly peeled away therefrom.
Figure 4:
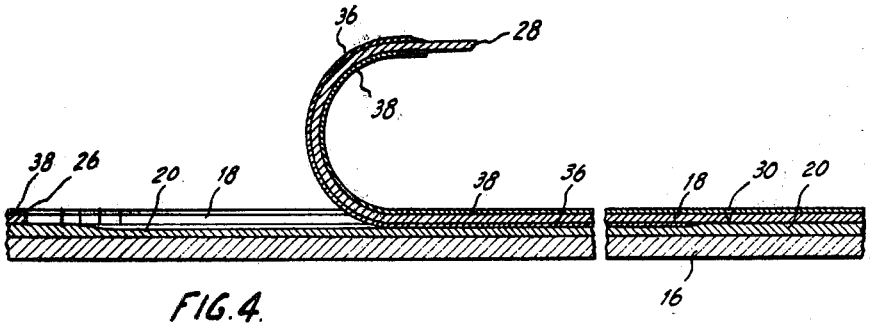
FIG. 4 is a sectional view of said carton panel or wall taken along the line 4—4 of FIG. 2.

The carton is manufactured from webs of packaging material which are laminated together and include, as can be seen in FIGS. 3 and 4, an inner ply 16 constituting a bendable grade of paperboard or the like and an outer ply 18 of high grade paper of a quality suitable for receiving the printing of the usual carton graphics, labelling, product identification and etc., and bonded to the substrate paperboard ply 16 by a laminant 20. Incorporated in the rear panel 12 of the carton is a removable or peelable section 22 of the outer paper ply 18 which is defined by a tear outline 24.

As disclosed in the aforementioned pending application Ser. No. 002,701, the removable section 22 of the rear carton panel may contain a decorative image 25 printed in sublimation ink so as to be transferable to another article as an "iron-on" by application thereto of suitable heat and pressure. Thus, the removable section 22 having been given to the consumer as an integral part of the package of puchased merchandise, and having a value or utility in and of itself when separated from said package, constitutes a form of merchandising premium which is in common usage for sales promotion purposes. It will, of course, be understood that the removable section 22 of the rear panel may be treated or printed with indicia or designs in inks which are not heat transferable so as to produce another form of peelable premium. For example, said peelable section could be printed to represent a replica of a well-known work of art, a trading stamp or a cents-off coupon redeemable towards purchase of either the same or other merchandise of the manufacturer. Accordingly, by use of the term "premium" it is intended to refer to all such forms of instrumentalities which have a value or utility for the consumer, when removed from the container, which is separate and distinct from its usefulness as a portion of the container structure for the purchased merchandise.

The design of the tear outline 24 is such as to require that the tear or peeling action starts at a predetermined point in the periphery of the premium or coupon in order that the peeling thereof can be successfully accomplished. The shape of the tear outline is substantially rectangular except for one side thereof which is the intended starting edge and proceeds towards both side edges in slightly angled directions from its midpoint whereat a semi-circular cut 26 defines a pull tab area 28 which is the starting point for initiating the peeling action. The tear, when the tab is pulled in the direction of the opposite trailing edge of the coupon or premium, defined by a continuous slit 30, will proceed simultaneously in diverging directions along the series of slits 32 defining the leading or starting edge for the peeling action. The size and arrangement of the slits 32 having their end portions in overlapping relation to one another are designed to assure the divergent travel of the tear line in a direction which is generally transverse to the direction of applied force. When the tear action reaches the end slits 32 of the starting edge, it then proceeds along the discontinuous cuts 34 which define the side edges of the coupon or premium represented by the peelable section 22. The side edge cuts or perforations 34 run in the direction of applied force and terminate at opposite ends of the continuous cut 30 which as aforesaid is the trailing or final edge of coupon or premium to be separated from the carton.

It will of course be recognized that in order to permit ply separation between the peelable section 22 of the outer paper ply 18 and the paperboard substrate 16, provision must be made during the laminating stage of manufacture to prevent adhesive bonding between the section 22 of the paper ply and substrate 16. This may be achieved in various ways, but a preferred way is to apply to the backside of the peelable section 22, or at least major portion thereof, an adhesive repellent or release coating 36 which can readily be applied to the backside of the paper ply in the desired pattern during the printing operation. Said release agent or adhesive repellent material could be a paraffin wax or micro crystaline wax or any such medium which will resist adherence to the laminating adhesive 20.

In the disclosure of the aforesaid pending application Ser. No. 002,701, a perforated tear outline of similar configuration is disclosed, and in accordance with the teaching of said pending application a release agent is applied to the backside of the peelable section of the container outer ply including the pull tab area. Thus, in said prior construction the pull tab portion of the peelable section was not adhered to the substrate rendering the coupon readily removable at will but at the same time permitting successful tampering therewith and resultant removal of the coupon by persons other than the actual purchasers of the contained merchandise, thereby resulting in the problems heretofore pointed out. Also, by rendering the pull tab of the coupon unadhered and freely accessible and exposed gives rise to the possibility that the pull tab could be displaced or torn away from the coupon inadvertently by frictional movement of one carton relative to another during normal handling and shipping thereof prior to their reaching their ultimate point of sale.

In accordance with the invention, this problem of inadvertent tearing or destruction of the pull tab, as well as the unauthorized intentional tampering therewith by unauthorized persons, is minimized or substantially avoided by manufacturing the carton with the pull tab area 28 of the premium or coupon 22 adhered to the substrate paper board 16 subject, however, to being readily separable upon application thereto of a conditioning agent not readily available at the point of sale which is where illegal tampering with the coupon or premium and removal thereof is most likely to appear. This result is achieved by utilizing in the laminating process a laminant 20 which is a water soluble adhesive such as dextrin or the like. Additionally, during the printing operation of the paper outer ply 18 the release coating 36 is applied to the backside of the premium 22 in a pattern which excludes the pull tab area. This can be clearly seen in FIG. 1 wherein the pattern of application of the release agent 36 is seen to closely parallel the tear outline 24 except at the leading edge where it departs and runs inside the edge in the area of the pull tab 28 thereby enabling the pull tab to bond to the underlying substrate of paper board 16 during the course of manufacture of the laminated material.

As can clearly be seen in FIG. 1, the side edges of the release coating pattern follow closely and parallels the side edges of the coupon or premium 22 defined by the perforations 34. The pattern is slightly outside this portion of the tear outline in order to assure in these areas a complete coating of release agent on the backside of the coupon while making allowance for registration tolerances involved in the course of manufacture. At the trailing edge of the coupon or premium defined by the continuance cut 30 the corresponding edge of the release coating pattern runs slightly inside thereof which leaves a border or marginal portion of the trailing edge of the coupon adhered to the substrate 16. As explained in the aforementioned pending application Ser. No. 002,701, this construction results from the desirability of having the trailing edge in the form of a continuous cut which, absent the marginal adherence to the substrate, would provide a point or area of the coupon which could be easily grasped and lifted up to initiate a peeling of the entire coupon in a direction and in a manner that was not intended. Since the trailing edge of the coupon or premium runs transverse to the direction of applied force during the peeling action, if the edge were defined by a series of discontinuous cuts such as the perforations 34, the trailing edge, it has been found, tends to separate in an uneven and unclean manner leaving fiber strands hanging either from the edge of the coupon or from the edge of the ply remaining adhered to the substrate. In other words, in the land areas between the discontinuous perforations the fibers of the paper would pull apart and separate in the direction of the applied force. This problem is eliminated by utilizing a continuous cut 30 whereby separation of the trailing edge of the coupon in the border area bonded to the substrate is by rupture of the fibers in the paper ply itself, but the separation of fibers in the paper is definitely terminated at the point of the cut so that the resultant edge of the coupon and the edge remaining adhered are clean and free of any trailing fiberous material.

Preferably there is also applied to the top side of the outer paper ply 18 a patterned application of a water repellent material which may be such as styrene, acrylic or the like prepared in the form of a lacquer. This may readily be applied in conjunction with the printing of the outer paper ply, and the pattern is one which covers at least the surface of the coupon or premium 22 except for the pull tab area 28 and may also cover adjacent areas of the rear panel 12. This water repellent coating in addition to providing scuff proof protection to the printed matter contained on the premium or coupon also protects the coupon in areas other than the pull tab area from damage or weakening by water penetration inadvertently in the course of applying moisture to the pull tab to initiate peeling action. It will be noted that the structure of the tear outline 24 dictates the area of the coupon at which the peeling action must be started in order to achieve a successful peeling off of the premium, this area being the area of the pull tab 28. The continuous cut 30 at the trailing edge of the coupon does not provide a gripping edge area to initiate a peeling action since the entire border area along the cut is bonded to the substrate. The side edges of the coupon defined by the perforations 34 and that portion of the leading edge defined by the overlapping cuts 32 are not of sufficient lengths as to provide a free edge area which can be readily engaged to start a peeling action of the coupon.

Although the disclosed embodiment of the invention shows the intended starting point for the peeling action to be in the configuration of a protuberance in the leading edge of the coupon such as the pull tab area 28, such a configuration is not essential to the practice of the invention. For example, the tear outline for a peelable coupon or the like could comprise an essentially straight tear line without any protuberance therein whatsoever as long as such tear line includes a cut or slit of sufficient length to enable its lifting up and grasping by the consumer to initiate the peeling action. It, of course, is understood that the area of such coupon bordering such slit would be initially bonded to the substrate by a water soluble laminant which would first be rendered ineffective by application of moisture thereto to enable such edge portion to be grasped.

From the foregoing detailed description it will be apparent that the instant invention renders the use by manufacturers of on-package peelable premiums or the like more attractive and viable as a method for distributing promotional items of this character. It retains the advantage of easy removal of the coupon without effecting the structural integrity of the carton and all the attendant benefits and conveniences attributable thereto while at the same time it hinders and discourages tampering therewith by unauthorized persons at various points in the channels of distribution, especially at the point of sale, since it requires preconditioning by application of an agent thereto which is not ordinarily available to such unauthorized persons at the point of sale.

While there has been shown and described what is considered to be a preferred embodiment of the invention, it of course will be understood that various changes in form and detail could be made without departing from the spirit of the invention. It is therefore intended that the invention be not limited to the exact form and details herein shown and described nor to anything less than the whole of the invention as hereinafter claimed.

What is claimed and desired to be secured by Letters Patent is:

1. In a container formed from laminated packaging material which comprises a relatively rigid substrate and a more pliable outer ply adhered thereto and including a section manually removable therefrom, said section being defined by a tear outline comprising a series of spaced apart and adjacently disposed cuts through said outer ply, at least one of said cuts along a predetermined side of said tear outline being long enough to define the edge of a border area of sufficient size to enable a finger grip to be had thereof, said outer ply being a moisture permeable material and adhered to said substrate by water soluble adhesive in areas exclusive of said section and in the said border area of said section, said section being unadhered to said substrate in substantially the entire remaining area thereof, whereby application of moisture to said border area renders the adhesive thereon ineffective and said border area manually engageable for applying pulling force thereto to peel said section from said substrate along the said tear outline.

2. The invention according to claim 1 wherein said adhesive covers the entire surface area of said substrate, and said remaining area of said manually removable section of said outer ply is coated with an adhesive repellent to prevent adherence thereof to said substrate.

3. The invention according to claim 1 wherein said manually removable section contains a coating on its outer surface of a water repellent substance over its entire area exclusive of said border area.

4. The invention according to claim 1 wherein said tear outline follows a substantially rectangular pattern, and said one cut in said predetermined side of the tear outline defines the edge of an outward protuberance in said predetermined side of said outline, said protuberance constituting a pull tab manually engageable for starting the peeling away of said section from said substrate.

5. The invention according to claim 4 wherein the side of said tear outline opposite to said predetermined side is a continuous cut defining the trailing edge of said removable section, the border area of such section along said continuous cut being adhered to the substrate.

6. In a carton constructed of laminated packaging material comprising a substrate of paperboard and an outer ply of paper bonded thereto with a wate soluble laminant, a manually removable section incorporated in said outer ply within one panel of said carton, said section being defined by a weakened tear outline comprising a series of spaced apart and adjacently disposed cuts through said outer ply, one of said cuts in a predetermined side of said tear outline being long enough to define the edge of a border area of sufficient size to enable a finger grip to be had thereof, said section being adhered to said substrate in said border area of said section and unadhered to said substrate in substantially the entire remaining area thereof, said cut defining said border area operably inter-connecting adjacent portions of said tear outline defining unadhered edges of said section, whereby application of moisture to said border area to render the adhesive thereon ineffective and said border area manually engageable enables said section to be manually peeled from said substrate along said tear outline.

7. The invention according to claim 6 wherein the said remaining area of said removable section on its under surface contains an adhesive repellent coating to prevent adherence of said area with said paperboard substrate.

8. The invention according to claim 6 wherein the outer surface of said outer paper ply is coated with a water repellent substance in the area thereof exclusive of said border area to prevent moisture penetration thereof upon application of moisture to said border area.

9. The invention according to claim 6 wherein said tear outline is in the general configuration of a rectangle and said one cut in said predetermined side thereof defines a border area in the shape of an outward protuberance in said side constituting a pull tab manually engageable upon application of water thereto to start the manual peeling action severing said section from said carton.

10. The invention according to claim 9 wherein the side of said tear outline opposite to said predetermined side constitutes a continuous cut defining the trailing edge of said removable section, the border area of said section along said trailing edge being adhered to the paperboard substrate and peelably removable therefrom by fiber separation of the paper ply in said border area.

* * * * *